US007951466B2

(12) United States Patent
Sakashita et al.

(10) Patent No.: US 7,951,466 B2
(45) Date of Patent: May 31, 2011

(54) TITANIUM ALLOYS EXCELLENT IN HYDROGEN ABSORPTION-RESISTANCE

(75) Inventors: Shinji Sakashita, Kobe (JP); Takashi Yashiki, Osaka (JP); Katsuhiro Matsukado, Kobe (JP); Takenori Nakayama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 602 days.

(21) Appl. No.: 10/522,779

(22) PCT Filed: Feb. 6, 2003

(86) PCT No.: PCT/JP03/01213

§ 371 (c)(1),
(2), (4) Date: Feb. 1, 2005

(87) PCT Pub. No.: WO2004/015151

PCT Pub. Date: Feb. 19, 2004

(65) Prior Publication Data

US 2005/0260433 A1 Nov. 24, 2005

(30) Foreign Application Priority Data

Aug. 7, 2002 (JP) ..... 2002-229433

(51) Int. Cl.
*C25D 11/02* (2006.01)
*C22C 14/00* (2006.01)

(52) U.S. Cl. ..... 428/629; 148/421; 420/418

(58) Field of Classification Search ..... 420/417–421; 148/421, 277, 281, 284, 285, 516, 527, 537; 181/213; 252/519.12; 205/102–105, 188, 205/190–193, 230, 233, 234, 237; 427/320, 427/456; 106/287.17
See application file for complete search history.

(56) References Cited

U.S. PATENT DOCUMENTS

| | | | | |
|---|---|---|---|---|
| 2,998,642 | A * | 9/1961 | McCawley | 428/660 |
| 3,113,227 | A * | 12/1963 | Bomberger et al. | 310/55 |
| 4,465,524 | A * | 8/1984 | Dearnaley et al. | 148/316 |
| 4,478,648 | A | 10/1984 | Zeilinger et al. | |
| 4,936,927 | A * | 6/1990 | Grunke et al. | 148/549 |
| 5,252,362 | A | 10/1993 | Khan et al. | |
| 5,395,461 | A * | 3/1995 | Taki et al. | 148/208 |
| 6,066,359 | A * | 5/2000 | Yao et al. | 427/126.3 |
| 6,599,636 | B1 * | 7/2003 | Alger | 428/472 |

FOREIGN PATENT DOCUMENTS

| | | | |
|---|---|---|---|
| EP | 0 267 349 A1 | * | 5/1988 |
| EP | 0816007 | * | 1/1998 |

(Continued)

OTHER PUBLICATIONS

Yen, S.K.; Corrosion Science (1999) 2031-2051.*

(Continued)

*Primary Examiner* — Scott Kastler
*Assistant Examiner* — Vanessa Velasquez
(74) *Attorney, Agent, or Firm* — Oblon, Spivak, McClelland, Maier & Neustadt, L.L.P.

(57) ABSTRACT

A titanium alloy material includes a Ti—Al alloy and an oxide film on the Ti—Al alloy. The Ti—Al alloy contains 0.50-3.0 mass % Al and a balance of Ti and unavoidable impurities. The titanium alloy material has excellent hydrogen absorption resistance and can be used as a basic structural material in hydrogen absorption environments.

10 Claims, 2 Drawing Sheets

FOREIGN PATENT DOCUMENTS

| | | | | |
|---|---|---|---|---|
| EP | 1 126 139 | | | 8/2001 |
| EP | 1126139 | A2 | * | 8/2001 |
| JP | 61276996 | A | * | 12/1986 |
| JP | 4-143235 | | | 5/1992 |
| JP | 6-173083 | | | 6/1994 |
| JP | 6-322522 | | | 11/1994 |
| JP | 7-3364 | | | 1/1995 |
| JP | 7-27884 | | | 1/1995 |
| JP | 08-337853 | | | 12/1996 |
| JP | 10-072642 | | | 3/1998 |
| JP | 2824174 | | | 9/1998 |

OTHER PUBLICATIONS

Lampman, S., "Wrought Titanium and Titanium Alloys," vol. 2: Properties and Selection: Nonferrous Alloys and Special-Purpose Materials, ASM Handbook, 1990. (6 pages total submitted, including front matter).*

Lutjering, Gerd and James C. Williams, Titanium, Springer, 2003, pp. 31-50.*

Shreir, L.L.; Jarman, R.A.; Burstein, G.T.; Corrosion, Butterworth Heinemann, 1994, vols. 1 and 2, Chs. 4.1 and 5.4, pp. 4:1 to 4:37, pp. 5:36 to 5:61.*

* cited by examiner

TITANIUM ALLOYS EXCELLENT IN HYDROGEN ABSORPTION-RESISTANCE

TECHNICAL FIELD

This invention relates to a titanium alloy used in environments where there is a risk of fracture damage due to hydrogen absorption, and more specifically to a titanium alloy material suitable for use in chemical plants using acid solutions, ammonia, hydrogen sulfide gas, hydrogen gas and carbon dioxide gas, seawater desalination plants, or heat exchangers such as water supply heaters and recirculation units, and pipes.

BACKGROUND ART

Pure titanium or titanium alloys (hereafter may be referred to simply as titanium alloys) have excellent corrosion resistance in various corrosive environments where chlorides are present such as in seawater, and are heavily required in chemical plants or seawater desalination plants. However, titanium has a great affinity for hydrogen, and depending on the environment, it may therefore absorb a large amount of hydrogen. For example, if a titanium alloy is used for heat exchanger tubes in a seawater desalination plant, cathodic protection (cathode anti-corrosion) is given to prevent corrosion of steel materials in contact with the titanium alloy, but if this is done, the electrical potential of the members foi flied by the titanium alloy falls below the hydrogen generation potential, and the generated hydrogen is absorbed by the titanium alloy materials.

Titanium alloys easily absorb hydrogen in the aforesaid heat exchanger tubes, non-oxidizing acid solutions, hydrogen sulfide atmospheres such as those found in petroleum refineries, high-temperature steam environments such as the turbine blades of power generating stations and the high temperature gases of chemical plants.

Also, when titanium alloy materials come in contact with steel parts, and hydrogen is generated due to corrosion of the steel parts, the titanium alloy materials absorb this hydrogen and become brittle. When titanium alloy absorbs hydrogen, brittle hydrides are formed inside the titanium alloy, and if the amount of these hydrides is large, the member formed by this titanium alloy shatters even if a small external force less than the design stress acts on the member (hydrogen embrittlement fracture).

Due to the problem of embrittlement resulting from hydrogen absorption, the use of titanium alloy as a structural material is prohibited in environments where such hydrogen absorption may occur.

An example of a technique to prevent embrittlement of titanium alloy is for example to suppress hydrogen absorption by exposing the titanium alloy to atmospheric oxidation, as disclosed in the Journal of the Japan Seawater Academy No. 44, Vol. 3, or Anti-Corrosion Technology Vol. 28, p. 490 (1979). Specifically, when an oxide film is formed on the titanium alloy surface due to atmospheric oxidation, this oxide film blocks diffusion of hydrogen and thus suppresses infiltration of hydrogen into the alloy from the environment.

Further, in Japanese Patent No. 2824174 or Japanese Patent Application Laid-Open (JP-A) No. 07-3364, the infiltration of hydrogen is suppressed by making the surface coverage of titanium carbide, titanium nitride or titanium carbide/nitride equal to 1.0% or less. Specifically, titanium carbide, titanium nitride or titanium carbide/nitride is always formed during manufacturing processes such as rolling or annealing. The technique disclosed in Japanese Patent No. 2824174 describes the suppression of hydrogen absorption by reducing the amount of titanium carbide/nitride which would increase the hydrogen absorption rate of titanium alloy.

If an oxide film which blocks hydrogen diffusion is formed on the surface of a titanium alloy member subjected to atmospheric oxidation as described above, absorption of hydrogen by the titanium can be suppressed to some extent. However, when structural materials are used, it is difficult to avoid contact and shocks with other materials during construction work, so the atmospheric oxide film formed on the surface of the titanium alloy material becomes scratched or peels off. If this type of scratching or peeling occurs, this part is easily infiltrated by hydrogen, so compared to a titanium alloy material having an ideal atmospheric oxidation film formed in the laboratory, the hydrogen absorption suppression effect in actual materials is less.

The hydrogen absorption of titanium alloy can be suppressed to some extent also by reducing the surface coverage amount of titanium carbide/nitride. However, titanium alloy itself has a large affinity for hydrogen, so even if the surface amount of titanium carbide/nitride which accelerates hydrogen absorption is reduced, a satisfactory hydrogen absorption suppression effect cannot be obtained. Moreover, since titanium has a large affinity for carbon and nitrogen, even if the surface amount of titanium carbide/nitride formed in the manufacturing step is sufficiently removed, titanium carbide/nitride may be subsequently formed which increases the hydrogen absorption amount.

At the same time, when titanium alloy is used as a structural material for heat exchanger tubes or chemical equipment parts, cold working properties of identical level to that of JIS 2 pure titanium are required.

It is therefore an object of this invention, which was conceived in view of the above problems, to provide a titanium alloy material which could be used without risk of embrittlement fracture in environments where hydrogen is easily absorbed, and which has the same cold working properties as those of pure titanium.

DISCLOSURE OF THE INVENTION

The Inventor, after extensive research on titanium hydrogen absorption properties, discovered that (1) hydrogen diffusion in a Ti—Al alloy is slower than that in pure Ti, therefore if a specific amount of Al is added to pure Ti, the hydrogen diffusion rate in the Ti—Al alloy can be suppressed so hydrogen absorption can be suppressed, and (2) if a hydrogen diffusion suppression layer is formed on the surface of the titanium alloy, the hydrogen absorption resistance of the Ti—Al alloy can be largely enhanced, and thereby arrived at the present invention.

The titanium alloy material described herein is a titanium alloy material which can be used as a structural material in hydrogen absorption environments, and is formed by a Ti—Al alloy containing Al: 0.50-3.0% (hereafter, all chemical components are expressed in terms of mass %), the remainder being Ti and unavoidable impurities. The amounts of Fe, Mo, Ni, Nb and Mn contained as impurities in this Ti—Al alloy are preferably suppressed to Fe: 0.15% or less, Mo: less than 0.10%, Ni: less than 0.20%, Nb: less than 1.0% and Mn: less than 1.0%.

The titanium alloy material according to the present invention comprises a bulk part formed by a Ti—Al alloy having the aforesaid desirable chemical composition and an oxide film which covers the alloy, the preferred thickness of this oxide film being within the range of 1.0-100 nm. In this case, 50% or more of the oxide film is preferably formed from a crystalline oxide. Also, even better hydrogen absorption resistance properties are obtained by forming an Al concentration layer having an Al concentration which is 0.3% higher or more than that of the bulk part, and lying within the range of 0.8-25%, between the bulk part and oxide film or on the bulk part, and this is therefore preferred. This Al concentration layer is preferably formed in a thickness of 0.10-30 μm.

The titanium alloy material of the present invention has excellent hydrogen absorption resistance in environments where hydrogen easily tends to be absorbed such as in the presence of acid solutions, ammonia, hydrogen sulfide gas or hydrogen gas, or when cathodic protection has been given, and in particular it has excellent hydrogen absorption resistance in applications where it is in contact with steel materials.

1: bulk part
2: oxide film
3: Al concentration layer

BEST MODE FOR CARRYING OUT THE INVENTION

The titanium alloy of the present invention contains Al: 0.50-3.0%, the remainder being formed of a Ti—Al alloy comprising Ti and unavoidable impurities.

The reason why titanium alloy with addition of Al as a metal element has excellent hydrogen absorption resistance, is thought to be due to the fact that the hydrogen diffusion rate is much smaller than that in pure Ti. The hydrogen diffusion rate in Ti—Al alloy is smaller the larger the Al content is, and when the Al content is less than 0.50%, the hydrogen absorption rate is not sufficiently slowed and a sufficient hydrogen absorption suppression effect is not obtained. Consequently, the lower limit of the Al content was set at 0.50%, but it is preferably 1.0% or more.

If on the other hand the Al content is too large, cracks tend to occur during cold working, and cold working properties remarkably decline. If cold rolling is performed under a reduction of 75%, and if the Al content is within the range of 2.5-3.0%, cracks are very minute even if they do occur and consequently they can be easily removed. If the Al content exceeds 3.0%, the cracks become very large, their removal is difficult and productivity remarkably declines. Therefore, the Al content should be maintained at 3.0% or less, but should preferably be suppressed to 2.5% or less.

If the lower limit of the reduction during cold rolling can be maintained at 75%, the material can be formed into a thin sheet by an identical process to that of JIS 2 pure titanium which is widely used at present in welded titanium tubes.

Figure 1:
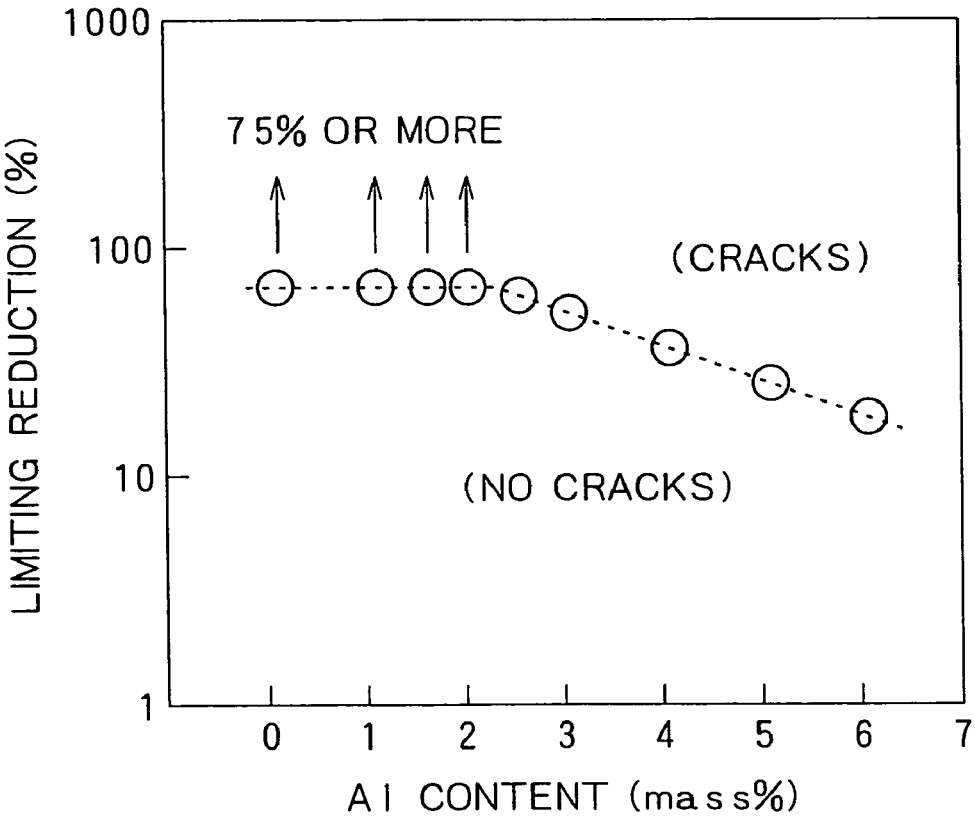
FIG. 1 is a graph showing the effect of the Al content in a Ti—Al binary alloy on cold working properties.

FIG. 1 shows the effect of Al content in a Ti—Al binary alloy on cold rolling properties, and shows, in graphical form, the reduction (limiting reduction) immediately prior to the formation of cracks during cold rolling. In this experiment, the upper limit of the reduction was taken as 75%.

As can be seen from FIG. 1, when the Al content is within a range of 2-2.3% or less, cracks do not occur even if cold rolling is performed under a reduction of 75%, and sufficient cold rolling properties can be ensured. However, when the Al content exceeds 2.5%, the limiting reduction clearly falls, and when it exceeds 5.0%, not only cracks, but other large fractures appear over the whole width of the sheet. When the Al content exceeds 2.5% but does not exceed 3.0%, productivity declines due to cracks, but these cracks are small and are limited to the vicinity of the sheet edge, so the material can still easily be worked into a thin sheet or welded titanium tube.

In the Ti—Al alloy according to the present invention, the less elemental impurities such as Fe, Mo, Ni, Nb and Mn are present, the better, but according to the present invention, it is permitted that Fe is of the order of 0.20% or less, Mo is of the order of 0.15% or less, Ni is of the order of 0.25 or less, Nb is of the order of 1.1% or less and Mn is of the order of 1.1% or less. However, they are preferably suppressed to Fe: 0.15% or less, Mo: less than 0.10%, Ni: less than 0.20%, Nb: less than 1.0% and Mn: less than 1.0%.

Fe not only increases the hydrogen absorption amount of the titanium alloy, but also decreases its corrosion resistance. Moreover, if the Fe content exceeds 0.15%, the hydrogen overvoltage of the titanium alloy remarkably decreases which facilitates hydrogen generation, so hydrogen absorption resistance declines. As a result, the Fe content is preferably 0.15% or less, but more preferably 0.10% or less.

Mo, Ni, Nb, Mn are also elements which adversely affect hydrogen absorption resistance, and it is therefore preferred that Mo is suppressed to less than 0.10%, Ni is suppressed to less than 0.20%, Nb is suppressed to less than 1.0% and Mn is suppressed to less than 1.0%.

Figure 2:
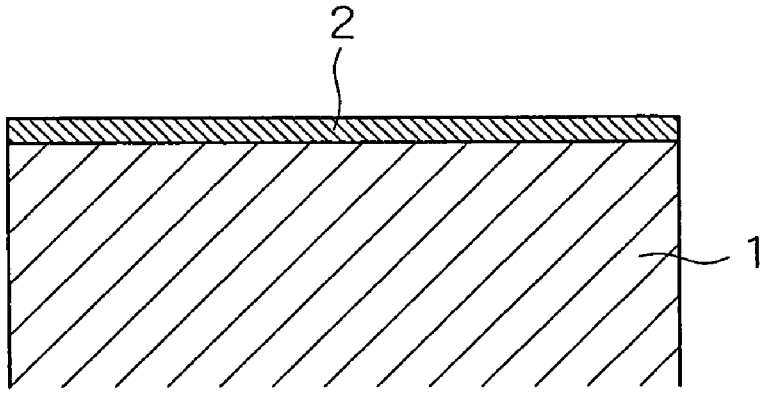
FIG. 2 is a cross-sectional schematic view of a titanium alloy material having an oxide film formed on the surface.

In another preferred form of the titanium alloy material according to the present invention, an oxide film 2 having a thickness of the order of 1.0-100 nm may be formed on the surface of a bulk part 1 comprising a Ti—Al alloy, for example as shown in FIG. 2. In a titanium alloy material having the aforesaid chemical composition, if an oxide film having a thickness of 1.0-100 nm is formed on the surface, a synergistic effect is obtained between the blocking of hydrogen diffusion by the oxide film and suppression of hydrogen diffusion by the parent alloy so that a highly enhanced hydrogen absorption resistance is obtained.

If the thickness of the oxide film is less than 1.0 nm, blocking of hydrogen diffusion is poor, so it is difficult to obtain the aforesaid synergistic effect with regard to suppression of hydrogen absorption. On the other hand, if the thickness of the oxide film exceeds 100 nm and it is too thick, partial cracks and peeling of the oxide film may occur during working, so suppression of hydrogen absorption again decreases. Due to this reason, the thickness of the oxide film formed on the surface of the titanium alloy material is preferably 1.0-100 nm.

The oxide film may be formed for example by thermal oxidation of a Ti—Al alloy material in an atmospheric environment or in an environment wherein the oxygen partial pressure has been suitably adjusted. By suitably adjusting the heating temperature and oxygen partial pressure in the environment, the film thickness can be controlled. The oxide film may also be formed by performing anodic oxidation in an electrolyte solution such as aqueous phosphoric acid solution. When anodic oxidation is performed, the film thickness of the anode oxide film may be controlled by adjusting the applied voltage or electrolyte temperature. However, the method of forming the oxide film is not limited to these methods.

The titanium alloy material of the present invention is normally obtained by forging ingots as required, annealing, hot rolling, annealing the hot rolled sheet as required, descaling, cold rolling to a predetermined thickness and annealing the cold rolled sheet thus obtained, but annealing and thermal oxidation may be performed simultaneously in the step for annealing the cold rolled sheet.

The thickness of the oxide film formed on the surface of the titanium alloy material according to the present invention is determined by the following method. Specifically, oxygen is analyzed while sputtering is performed in the thickness direction from the surface by Auger electron spectroscopy (AES), the thickness when the maximum value of the oxygen concentration has fallen to half is measured at 5 arbitrary points, and the average value thereof is taken as the thickness (average film thickness) of the oxide film.

According to the Inventor's observations, if part or all of the aforesaid oxide film is crystalline, the hydrogen absorption resistance of the titanium alloy is remarkably enhanced. Specifically, whereas the surface oxide film which is formed naturally in the atmosphere has a low crystallinity and a large amorphous part, the oxide film formed by the aforesaid methods is a crystalline oxide film of crystals such as Anatase, Rutile or Brookite on the surface of the Ti—Al alloy forming the bulk part. Due to the formation of this crystalline oxide film, the oxide film is even finer, the hydrogen diffusion blocking effect is enhanced, and hydrogen absorption is more effectively suppressed. This effect is exhibited regardless of the crystalline structure of the crystalline oxide in the oxide film, but Brookite which is orthorhombic is more preferred than Anatase or Rutile which are tetragonal.

The enhancement of hydrogen absorption resistance is marked when 50% or more of the surface oxide film is crystalline. The proportion of crystalline material is determined in the present invention by the following method. First, a specimen is cut perpendicular to the surface, a thin film sample is prepared by ion milling, and electron beam diffraction is performed at a magnification of 1 to 1.5 million times depending on the film thickness of the oxide film. Images are obtained at the diffraction peaks of the crystals, the crystalline part and amorphous part of the oxide film viewed from a cross-section are distinguished from each other, and the surface area factor of the crystalline part is found from the photograph. This electron beam diffraction is performed on an arbitrary 10 more thin film samples, and the average value of the surface area factor of the crystalline part is calculated. The crystal structure can also be identified by the same kind of electron beam diffraction.

The crystalline properties of the oxide film may be controlled as desired for example by adjusting the temperature or oxygen partial pressure during the thermal oxidation process, or the applied voltage or electrolyte temperature during the anodic oxidation process. The method of crystallization of the oxide film is however not limited to these methods.

Figure 3:
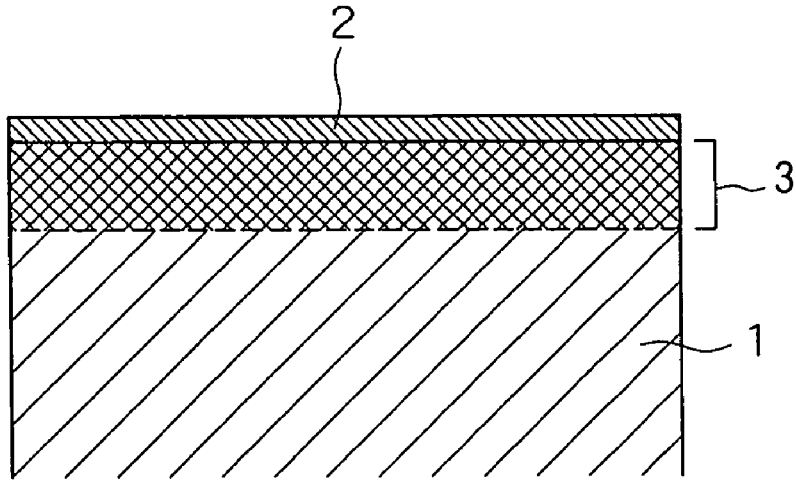
FIG. 3 is a cross-sectional schematic view of a titanium alloy material having an Al concentration layer and an oxide film.

Another suitable form of the titanium alloy material according to the present invention comprises an Al concentration layer 3 having an Al concentration 0.3% or more higher than that of the bulk part and lying within a range of 0.8-25%, formed between the bulk part 1 comprising Ti—Al alloy and the oxide film 2, as shown in FIG. 3. However, the oxide film 2 is not absolutely necessary, and even if the Al concentration layer 3 alone is formed in one piece on the bulk part 1, a superior hydrogen absorption resistance effect is still obtained compared to a bulk material comprising only Ti—Al alloy.

In the aforesaid invention, hydrogen diffusion is suppressed and hydrogen absorption resistance is enhanced by adding a suitable amount of Al to the titanium, however when Al is added, as described above, cold working properties decline. Therefore, if only the Al content of the surface layer is increased, the hydrogen absorption suppression effect can be enhanced without impairing cold working properties, and hydrogen absorption resistance can be very significantly enhanced due to the synergistic effect of the super thin oxide film.

As described above, if the Al concentration of the bulk part of the Ti—Al alloy is 0.5% or more, a strong hydrogen diffusion blocking effect is observed and an excellent hydrogen absorption suppression effect is obtained, but if the Al concentration of the Al concentration layer is increased to 0.3% or more than that of the bulk part, the hydrogen absorption suppression effect can be still further enhanced.

The lower limit of the Al content in the Al concentration layer is approximately 0.8% from the minimum difference between the lower limit of the Al content of the bulk part and the Al amount of the bulk part. However, if the Al content of the Al concentration layer exceeds 25%, a very brittle $\gamma$ phase based on Ti—Al is produced, and the surface layer (Al concentration layer and oxide film) easily cracks and peels during working. As hydrogen infiltrates from cracked or peeled parts of the surface layer, the hydrogen diffusion blocking effect is no longer observed. For this reason, it is desirable to suppress the Al content of the Al concentration layer to 25% or less. Further, it is preferably 16% or less which is the component range wherein a $\epsilon$ phase is not produced, and more preferably 6% or less which is the component range at which an $\alpha$ 2 phase ($Ti_2Al$) is not produced.

If the thickness of the Al concentration layer is 0.10 μm or more, the hydrogen absorption suppression effect is enhanced compared to the case where there is no Al concentration layer (only bulk part). However, if this thickness exceeds 30 μm and the layer becomes too thick, the Al concentration layer easily peels during working, and the hydrogen absorption suppression effect deteriorates. Therefore, it is desired that the thickness of the Al concentration layer is within the range of 0.10-30 μm.

However, if an alloy wherein a low melting point metal such as Al is added to a high melting point metal such as Ti, is heated, the concentration may vary due to diffusion of the low melting point metal in the surface part. This phenomenon occurs due to the difference of vapor pressures between the high melting point metal and low melting point metal. If the surface oxide film is removed, the surface concentration of the low melting point metal falls, whereas if the surface oxide film is formed, the surface concentration increases. Therefore, concerning the Al concentration layer, the Al concentration and thickness of the Al concentration layer can be controlled as desired by adjusting the temperature and oxygen partial pressure during thermal oxidation as described above. Also, when performing anodic oxidation, the Al concentration of the Al concentration layer can be controlled as desired in a similar way by adjusting the applied voltage and electrolyte temperature. However, the method of forming the Al concentration layer is not limited to the above methods.

The Al concentration (average concentration) and thickness of the Al concentration layer can be measured by the Auger electron spectroscopy method, and performing an Al elemental analysis with sputtering in the depth direction from the surface.

EXAMPLES

Hereafter, this invention will be described in more detail referring to the examples, but it should be understood that the invention is not to be construed as being limited in any way thereby, and may be modified as required in the spirit of the appended claims which are included within the scope of the present invention. In the following, "%" refers to "mass %" unless otherwise specified.

Example 1

Evaluation of Hydrogen Absorption Resistance by Galvanostatic Electrolysis Method The titanium alloys shown in Table 1 were manufactured in a vacuum arc melting furnace using pure metals such as JIS class 1 (equivalent to ASTM Gr. 1) as starting materials so as to manufacture ingots (approximately 500 g). After thermal refining annealing, (1000° C.×2 hours), they were formed into sheets of thickness 4.2 mm by hot rolling (800-900° C.). Next, after removing scale by pickling, they were cold-rolled to a sheet thickness of 1.0 mm, and the cold rolled properties of the samples were evaluated from the cracks produced during cold rolling.

Subsequently, a 10 mm×10 mm piece was cut from each sheet which had been vacuum annealed (800° C.×1 hour), galvanostatic cathodic charge was performed in 0.1 mol/L $H_2SO_4$ aqueous solution (80° C., aerated) immediately after wet polishing (emery paper #1200), and the absorbed hydrogen amount was measured. The current density at this time was—1 mA/cm$^2$, charge time was 240 hours, and the absorbed hydrogen amount was measured by the melting method. The evaluation results for cold rolling properties and hydrogen absorption properties obtained in this experiment are shown in Table 1.

Table 1 shows that the sample in the example of the present invention has excellent cold rolling properties and hydrogen absorption resistance compared to sample No. 1 comprising JIS class 1 pure Ti used as the starting material. In particular, for samples Nos. 9-11 (Examples) for which the Al content is 1.0% or more, and impurity amount has been reduced to less than a predetermined value, the improvement of hydrogen resistance properties is remarkable.

Example 2

Evaluation of Hydrogen Absorption Resistance Due to Hydrochloric Acid Immersion

Hydrochloric acid was taken as a typical harsh corrosive environment wherein hydrogen absorption easily occurs, and an immersion corrosion test was performed.

The titanium alloy test pieces shown in the following Table 2 were manufactured by an identical method to that of Example 1. For the test pieces used in this example, anodic oxidation treatment was given in a 1 vol % phosphoric acid aqueous solution after vacuum annealing. The applied voltage at this time was 1-50 V, the electrolyte temperature was suitably varied within a range of 20-50° C., and the thickness and crystallinity of the oxide film formed on the surface of the bulk material were examined. The thickness of the oxide film was measured by Auger electron spectroscopy as described above, and the proportion (crystallinity) and crystal structure of the crystalline part were found by electron diffraction.

The hydrochloric acid immersion test was performed in 0.1 moles/L-HCl aqueous solution (boiling), and the immersion time was 10 days. The corrosion rate was found by the weight change before and after the immersion test, and the absorbed hydrogen amount was measured by the melting method. Finally, the cold working properties of each test piece were also evaluated by the aforesaid method.

Table 2 shows the measurement results for cold working properties, film thickness of oxide film and hydrogen absorption amount. For all samples, the corrosion rate was 0.01 mm/y or less.

From Table 2, it is seen that the samples in the examples satisfying the specified conditions of the present invention have similar cold working properties and corrosion resistance to those of JIS class 1 sample No. 21 (pure Ti) used as the starting material, and a superior hydrogen absorption resistance to that of pure titanium. In particular, for samples Nos. 31-38 for which the Al content is 1.0% or more, the film thickness of the oxide film is 1.0 nm or more and crystals account for 50% or more, an excellent hydrogen absorption resistance is observed.

No. 39, although the oxide film is almost completely crystalline, its thickness is greater than 100 nm and hydrogen absorption properties therefore decline.

Example 3

Evaluation of Hydrogen Absorption Resistance in Contact with Steel Member

Test pieces were prepared by an identical method to that of Example 2. For the test pieces used in the present invention, atmospheric oxidation treatment was given after anodic oxidation treatment. The film thickness and crystallinity of the surface oxide film, and the Al content and thickness of the Al concentration layer, were adjusted by adjusting the oxidation temperature and treatment time.

The thickness and crystallinity of the oxide film were found by Auger electron spectroscopy and electron diffraction in the same way as in Example 2. The Al concentration distribution in the thickness direction from the surface of the test piece was measured by Auger electron spectroscopy, and the average Al concentration and thickness of the Al concentration layer were calculated.

A 30 mm×30 mm test piece was cut out from a sheet, a 5 mm diameter hole was opened in the centre of the test piece, the test piece was stuck to carbon steel (JIS SPCC) of identical shape, and the product was immersed in a corrosive solution while tightened by titanium nuts and bolts. The corrosive solution used was 3% NaCl aqueous solution (boiling), and the immersion time was 2 months. The hydrogen absorption amount after the test was measured by the melting method, and the results are shown in Table 3.

The cold rolling properties were also evaluated in an identical manner to that of Example 1 and 2, and for all samples, no cracks were observed during cold working.

As can be seen from Table 3, for Examples Nos. 46-59 on which the Al concentration layer was formed, and in particular for examples Nos. 50-59 for which the layer thickness was 0.10 μm or more, excellent hydrogen absorption resistance is obtained regardless of the film thickness and crystallinity of the oxide film formed on the surface.

INDUSTRIAL APPLICABILITY

In the titanium alloy material of the present invention, the bulk material comprising Ti—Al alloy, the oxide film formed on the bulk part comprising this alloy, the Al concentration layer, or the Al concentration layer and oxide film, exhibit a high hydrogen diffusion resistance, and an excellent hydrogen absorption resistance is therefore observed. This Ti—Al alloy has equivalent cold working properties to those of pure Ti, so it can easily be worked into various shapes. Moreover, the corrosion resistance is equivalent to that of pure Ti, so the corrosion resistance is more satisfactory than that of carbon steel or stainless steel. Therefore, the titanium alloy material of the present invention is suitable as a structural material exposed to harsh corrosive environments where hydrogen absorption easily occurs. Specifically, it can usefully be employed as a basic material in chemical plants using acid solutions, ammonia, hydrogen sulfide gas, hydrogen gas and carbon dioxide gas, seawater desalination plants, or heat exchangers such as water supply heaters and recirculation units, and pipes.

TABLE 1

| Sample | Chemical Composition (mass %) | | | | | | | Cold working properties | Absorbed hydrogen amount | |
|---|---|---|---|---|---|---|---|---|---|---|
| No. | Al | Fe | Mo | Ni | Nb | Mn | Ti | *1 | *2 | Remarks |
| 1 | 0.02 | 0.07 | 0.02 | 0.07 | 0.02 | 0.01 | bal. | ◎ | X | Comparative Example |
| 2 | 0.48 | 0.08 | 0.10 | 0.07 | 0.08 | 0.03 | bal. | ◎ | X | Comparative Example |
| 3 | 0.51 | 0.18 | 0.08 | 0.06 | 0.08 | 0.02 | bal. | ◎ | Δ | Example |
| 4 | 1.02 | 0.08 | 0.08 | 0.25 | 0.07 | 0.02 | bal. | ◎ | ○ | Example |
| 5 | 2.46 | 0.07 | 0.11 | 0.23 | 0.04 | 0.01 | bal. | ◎ | ○ | Example |
| 6 | 2.77 | 0.08 | 0.06 | 0.21 | 0.06 | 0.02 | bal. | ◎ | ○ | Example |
| 7 | 3.05 | 0.19 | 0.12 | 0.15 | 0.08 | 0.04 | bal. | X | (not measured) | Comparative Example |
| 8 | 0.55 | 0.07 | 0.08 | 0.15 | 0.09 | 0.02 | bal. | ◎ | ○ | Example |
| 9 | 1.05 | 0.07 | 0.08 | 0.15 | 0.09 | 0.03 | bal. | ◎ | ○○ | Example |
| 10 | 2.48 | 0.07 | 0.06 | 0.16 | 0.10 | 0.03 | bal. | ◎ | ○○ | Example |
| 11 | 2.80 | 0.07 | 0.06 | 0.16 | 0.10 | 0.03 | bal. | ○ | ○○ | Example |
| 12 | 3.07 | 0.08 | 0.06 | 0.15 | 0.08 | 0.03 | bal. | X | (not measured) | Comparative Example |

(NB)
*1 Cold working properties
◎: No cracks,
○: Cracks of length up to 1 mm,
X: Cracks of length greater than 1 mm
*2 Hydrogen absorption amount
○○: Less than 100 ppm,
○: 100-499 ppm,
Δ: 500-999 ppm,
X: 1000 ppm or more

TABLE 2

| Sample | Chemical Composition (mass %) | | | | | | | Cold working properties | Surface oxide film | | | Absorbed hydrogen amount | |
|---|---|---|---|---|---|---|---|---|---|---|---|---|---|
| No. | Al | Fe | Mo | Ni | Nb | Mn | Ti | *1 | Film thickness (nm) | Crystallinity (%) | Structure *2 | *3 | Remarks |
| 21 | 0.02 | 0.08 | 0.05 | 0.07 | 0.08 | 0.02 | bal. | ◎ | 15 | 8.0 | A | X | Comparative Example |
| 22 | 0.51 | 0.18 | 0.08 | 0.06 | 0.08 | 0.02 | bal. | ◎ | 0.9 | 6.9 | A | Δ | Example |
| 23 | 0.51 | 0.18 | 0.08 | 0.06 | 0.08 | 0.02 | bal. | ◎ | 1.2 | 7.9 | A | ○ | Example |
| 24 | 2.08 | 0.09 | 0.08 | 0.06 | 0.08 | 1.01 | bal. | ◎ | 98 | 10.4 | B | ○ | Example |
| 25 | 1.02 | 0.10 | 0.08 | 0.15 | 0.07 | 0.02 | bal. | ◎ | 1.1 | 10.4 | B | ○○ | Example |
| 26 | 1.02 | 0.10 | 0.08 | 0.15 | 0.07 | 0.02 | bal. | ◎ | 25 | 12.0 | B | ○○ | Example |
| 27 | 1.02 | 0.10 | 0.08 | 0.15 | 0.07 | 0.02 | bal. | ◎ | 100 | 30.2 | B | ○○ | Example |
| 28 | 2.46 | 0.07 | 0.11 | 0.10 | 0.04 | 0.01 | bal. | ◎ | 12 | 12.5 | B | ○○ | Example |
| 29 | 2.77 | 0.08 | 0.06 | 0.13 | 0.06 | 0.02 | bal. | ○ | 99 | 45.8 | B | ○○ | Example |
| 30 | 0.51 | 0.18 | 0.08 | 0.06 | 0.08 | 0.02 | bal. | ◎ | 11 | 50.2 | A | ○○ | Example |
| 31 | 2.08 | 0.09 | 0.08 | 0.06 | 0.08 | 1.01 | bal. | ◎ | 1.2 | 50.1 | B | ○○○ | Example |
| 32 | 1.02 | 0.10 | 0.08 | 0.15 | 0.07 | 0.02 | bal. | ◎ | 50.6 | 75.0 | B | ○○○ | Example |
| 33 | 1.52 | 0.07 | 0.11 | 0.23 | 0.04 | 0.01 | bal. | ◎ | 20.1 | 89.9 | B | ○○○ | Example |
| 34 | 1.02 | 0.10 | 0.08 | 0.15 | 0.07 | 0.02 | bal. | ◎ | 1.0 | 70.3 | B | ○○○ | Example |
| 35 | 1.02 | 0.10 | 0.08 | 0.15 | 0.07 | 0.02 | bal. | ◎ | 95 | 52.3 | B | ○○○ | Example |
| 36 | 1.52 | 0.07 | 0.11 | 0.23 | 0.04 | 0.01 | bal. | ◎ | 30 | 99.1 | B | ○○○ | Example |
| 37 | 2.46 | 0.07 | 0.11 | 0.10 | 0.04 | 0.01 | bal. | ◎ | 1.2 | 96.5 | B | ○○○ | Example |
| 38 | 2.77 | 0.08 | 0.06 | 0.13 | 0.06 | 0.02 | bal. | ○ | 93 | 96.5 | B | ○○○ | Example |
| 39 | 2.46 | 0.07 | 0.11 | 0.10 | 0.04 | 0.01 | bal. | ◎ | 105 | 95.5 | B | Δ | Example |

(NB)
*1 Cold working properties,
◎: No cracks,
○: Cracks of length up to 1 mm,
X: Cracks of length greater than 1 mm
*2 Crystal structure:
R: Rutile,
A: Anatase,
B: Brookite
*3 Hydrogen absorption amount
○○○: 50 ppm,
○○: 50-99 ppm,
○: 100-499 ppm,
Δ: 500-999 ppm,
X: 1000 ppm or more

TABLE 3

| Sample | Chemical Composition (mass %) | | | | | | | Surface oxide film | | | Al concentration layer | | Absorbed hydrogen | |
|---|---|---|---|---|---|---|---|---|---|---|---|---|---|---|
| | | | | | | | | Film thickness | Crystallinity | Structure | Al | Thickness | amount | |
| No. | Al | Fe | Mo | Ni | Nb | Mn | Ti | (nm) | (%) | *1 | mass % | (μm) | *2 | Remarks |
| 41 | 0.02 | 0.07 | 0.02 | 0.07 | 0.02 | 0.01 | bal. | 5.0 | 8.3 | R | — | — | X | Comparative Example |
| 42 | 0.50 | 0.17 | 0.08 | 0.08 | 0.08 | 0.03 | bal. | 0.9 | 10.2 | R | (0.50) | — | Δ | Example |
| 43 | 2.98 | 0.08 | 0.08 | 0.06 | 0.08 | 0.02 | bal. | 0.8 | 25.3 | B | (0.51) | — | Δ | Example |
| 44 | 2.08 | 0.09 | 0.08 | 0.06 | 0.08 | 1.01 | bal. | 1.2 | 20.5 | B | (2.08) | — | ○ | Example |
| 45 | 1.50 | 0.08 | 0.08 | 0.07 | 0.07 | 0.02 | bal. | 13 | 50.2 | B | (1.50) | — | ○○ | Example |
| 46 | 0.51 | 0.08 | 0.08 | 0.22 | 0.07 | 0.02 | bal. | 5.4 | 9.8 | R | 0.82 | 0.09 | ○○○ | Example |
| 47 | 0.51 | 0.07 | 0.05 | 0.15 | 0.06 | 0.02 | bal. | 10 | 30.2 | R | 0.81 | 0.08 | ○○○ | Example |
| 48 | 0.52 | 0.07 | 0.11 | 0.10 | 0.06 | 0.01 | bal. | 1.5 | 50.1 | R | 0.82 | 0.09 | ○○○ | Example |
| 49 | 2.85 | 0.08 | 0.06 | 0.13 | 0.06 | 0.02 | bal. | 20.3 | 50.5 | B | 5.92 | 0.09 | ○○○ | Example |
| 50 | 0.51 | 0.19 | 0.08 | 0.06 | 0.08 | 0.02 | bal. | 11 | 10.7 | R | 1.31 | 0.10 | ○○○○ | Example |
| 51 | 0.52 | 0.10 | 0.08 | 0.15 | 0.08 | 0.02 | bal. | 50.6 | 10.5 | R | 1.22 | 0.11 | ○○○○ | Example |
| 52 | 1.56 | 0.11 | 0.11 | 0.10 | 0.06 | 0.01 | bal. | 12 | 9.9 | B | 2.97 | 0.10 | ○○○○ | Example |
| 53 | 2.98 | 0.08 | 0.06 | 0.13 | 0.06 | 0.02 | bal. | 20.3 | 11.2 | B | 5.92 | 0.12 | ○○○○ | Example |
| 54 | 2.98 | 0.08 | 0.06 | 0.13 | 0.06 | 0.02 | bal. | 10 | 20.6 | B | 3.45 | 29.9 | ○○○○ | Example |
| 55 | 0.50 | 0.18 | 0.08 | 0.15 | 0.07 | 0.02 | bal. | 95 | 50.3 | R | 1.39 | 0.23 | ○○○○ | Example |
| 56 | 0.52 | 0.07 | 0.08 | 0.14 | 0.04 | 0.01 | bal. | 30 | 99.1 | R | 0.82 | 1.5 | ○○○○ | Example |
| 57 | 1.49 | 0.08 | 0.09 | 0.10 | 0.04 | 0.01 | bal. | 1.2 | 96.5 | R | 2.33 | 0.15 | ○○○○ | Example |
| 58 | 2.81 | 0.08 | 0.06 | 0.13 | 0.06 | 0.02 | bal. | 8.6 | 75.1 | B | 4.92 | 3.3 | ○○○○ | Example |
| 59 | 2.98 | 0.08 | 0.09 | 0.10 | 0.04 | 0.01 | bal. | 99 | 95.5 | B | 3.58 | 30 | ○○○○ | Example |

(NB)
*1 Crystal structure:
R: Rutile,
A: Anatase,
B: Brookite
*2 Hydrogen absorption amount
○○○○: less than 10 ppm,
○○○: 10-49 pppm,
○○: 50-99 ppm,
○: 100-499 ppm,
Δ: 500-999 ppm,
X: 1000 ppm or more

The invention claimed is:

1. A heat exchanger for a seawater desalination plant which comprises a titanium alloy material, wherein the titanium alloy material comprises:

a Ti—Al alloy comprising 0.50-3.0 mass % of Al, Ti and unavoidable impurities;

an oxide film on the Ti—Al alloy; and an Al concentration layer between the Ti—Al alloy and the oxide layer, wherein:

the oxide film has a thickness of 1.0-100 nm;

the oxide film comprises 50 mass % or more of a crystalline oxide, the film being produced by a process comprising oxidizing the Ti—Al alloy;

the Al concentration layer has an average Al concentration in a range of from 0.8-6 mass %;

the Al content between the Ti—Al alloy and the oxide layer is 0.8-6 mass %; and the Al concentration of the Al concentration layer is 0.3 mass % or more higher than an Al concentration of the Ti—Al alloy.

2. The heat exchanger for a seawater desalination plant which comprises the titanium alloy material according to claim 1, wherein the unavoidable impurities comprise Fe, Mo, Ni, Nb and Mn; and the content of each of Fe, Mo, Ni, Nb and Mn in the Ti—Al alloy is Fe: 0.15 mass % or less, Mo: less than 0.10 mass %, Ni: less than 0.20 mass %, Nb: less than 1.0 mass % and Mn: less than 1.0 mass %.

3. The heat exchanger for a seawater desalination plant which comprises the titanium alloy material according to claim 1, wherein the Al concentration layer has a thickness of 0.10-30 μm.

4. The heat exchanger for a seawater desalination plant which comprises the titanium alloy material of claim 1 in contact with a steel member.

5. The heat exchanger for a seawater desalination plant which comprises the titanium alloy material according to claim 1, wherein the crystalline oxide comprises Brookite.

6. The heat exchanger for a seawater desalination plant which comprises the titanium alloy material according to claim 1, wherein the Al concentration layer has an average Al concentration in a range of from 3.45-5.92 mass %.

7. The heat exchanger for a seawater desalination plant which comprises the titanium alloy material according to claim 6, wherein the crystalline oxide comprises Brookite.

8. The heat exchanger for a seawater desalination plant which comprises the titanium alloy material according to claim 1, wherein the Ti—Al alloy consists of 0.50-3.0 mass % of Al, and a balance of Ti and unavoidable impurities.

9. The heat exchanger for a seawater desalination plant which comprises the titanium alloy material according to claim 1, wherein the Ti—Al alloy comprises:

1.0-2.5 mass % of Al, and a balance of Ti and unavoidable impurities.

10. A heat exchanger for a seawater desalination plant which comprises a titanium alloy material, wherein the titanium alloy material consists essentially of:

a Ti—Al alloy comprising 0.50-3.0 mass % of Al, Ti and unavoidable impurities;

an oxide film on the Ti—Al alloy; and an Al concentration layer between the Ti—Al alloy and the oxide layer, wherein:

the oxide film has a thickness of 1.0-100 nm;

the oxide film comprises 50 mass % or more of a crystalline oxide, the film being produced by a process comprising oxidizing the Ti—Al alloy;

the Al concentration layer has an average Al concentration in a range of from 0.8-6 mass %;

the Al content between the Ti—Al alloy and the oxide layer is 0.8-6 mass %; and the Al concentration of the Al concentration layer is 0.3 mass % or more higher than an Al concentration of the Ti—Al alloy.

* * * * *